US005481862A

United States Patent [19]

Wassenhoven

[11] Patent Number: 5,481,862

[45] Date of Patent: Jan. 9, 1996

[54] PNEUMATICALLY OPERATED DEBRIS REMOVAL DEVICE FOR AN OPEN-END SPINNING DEVICE

[75] Inventor: Heinz-Georg Wassenhoven, Monchengladbach, Germany

[73] Assignee: W. Schlafhorst AG & Co., Moenchengladbach, Germany

[21] Appl. No.: 312,113

[22] Filed: Sep. 26, 1994

[30] Foreign Application Priority Data

Oct. 9, 1993 [DE] Germany ..... 43 34 483.6

[51] Int. Cl.[6] ..... D01H 4/00; D01H 11/00

[52] U.S. Cl. ..... 57/301; 19/200; 19/303; 57/304; 57/406; 57/407; 57/412

[58] Field of Search ..... 57/301, 304, 406, 57/407, 412; 15/345, 301; 19/200, 303

[56] References Cited

U.S. PATENT DOCUMENTS

| | | | |
|---|---|---|---|
| 3,792,575 | 2/1974 | Doublesky et al. | 57/301 |
| 3,922,839 | 12/1975 | Sakurai et al. | 57/301 |
| 4,009,562 | 3/1977 | Stadler | 57/301 |
| 4,030,279 | 3/1977 | Rambousek et al. | 57/407 |
| 4,036,002 | 7/1977 | Kobayashi | 57/304 |
| 4,204,393 | 5/1980 | Miyazaki et al. | 57/301 |
| 4,308,717 | 1/1982 | Onoue et al. | 57/301 |
| 4,314,440 | 2/1982 | Onoue et al. | 57/301 |
| 4,753,067 | 6/1988 | Landwehrkamp et al. | 57/407 |
| 4,769,984 | 9/1988 | Raasch et al. | 57/407 |

FOREIGN PATENT DOCUMENTS

| | | | |
|---|---|---|---|
| 374382 | 6/1990 | European Pat. Off. | 57/301 |
| 2112170A | 9/1972 | Germany . | |
| 2210508A | 10/1972 | Germany . | |
| 2856058A | 3/1985 | Germany . | |
| 4310810 | 4/1993 | Germany . | |

*Primary Examiner*—Daniel P. Stodola
*Assistant Examiner*—William Stryjewski
*Attorney, Agent, or Firm*—Shefte, Pinckney & Sawyer

[57] ABSTRACT

An open-end spinning device (1) of the type having a sliver opening device (30) and a pneumatically operated debris removal device (34) is disclosed. The opening cylinder housing (11) of the sliver opening device (30) has a debris discharge opening (15) and a cover element (9) mounted for restricted pivoting movement on a pivot shaft (10). A debris collecting element (16) is affixed to the cover element at a spacing (33) beneath the debris discharge opening and is connected to a suction device (8) which is a part of the spinning machine. The clear space (33) between the debris discharge opening (15) and the debris collecting element (16) assures that an auxiliary air flow (29), which is effective in the area of the debris discharge opening (15) to control the transport of fibers for the spinning process, is not affected by a suction air flow (28) applied at the debris collecting element (16).

7 Claims, 2 Drawing Sheets

PNEUMATICALLY OPERATED DEBRIS REMOVAL DEVICE FOR AN OPEN-END SPINNING DEVICE

FIELD OF THE INVENTION

The present invention relates to an open-end spinning device with a sliver opening device and a pneumatically operated debris removal device which is disposed below the sliver opening device.

BACKGROUND OF THE INVENTION

In rotor spinning devices of the above-described type, as disclosed for example in German Patent Disclosure DE 21 12 170 A1, a sliver introduced between a drawing-in cylinder and a feeding trough is unraveled by an opening cylinder to become separated into individual fibers. In the course of this process, debris particles and fibers are separated to the greatest extent possible. The opening cylinder conveys both the fibers and debris over a fiber guide surface into the area of a debris discharge opening. In the course of this transport, the fibers as well as the debris particles are rapidly accelerated by the opening cylinder itself and by the air flow circulating around the opening cylinder to approach the circumferential speed of the opening cylinder. Because of the centrifugal forces acting on them, the fibers and debris particles tend to leave the circular path tangentially as soon as the forced mechanical guidance of the fiber guide surface is interrupted, such as is the case in the area of the debris discharge opening.

For this reason, a debris collecting chamber is disposed directly underneath the debris discharge opening and is connected via a conduit with the central suction unit of the spinning machine. In addition, this debris collecting chamber has an air inlet opening which can be closed by means of a slide.

A comparable open-end spinning machine, slightly modified in the area of the debris discharge opening, is described in German Patent Publication DE 28 56 028 A1.

To prevent the spinnable fibers from being removed from the opening cylinder in the area of the debris discharge opening in addition to the debris particles, the debris discharge opening also serves as an opening for an air flow entering the opening cylinder housing. This air flow is directed onto the opening cylinder to pneumatically guide and retain the fibers against the opening cylinder due to the relatively large specific surface area of the fibers in relation to their relatively low mass. The debris particles have a relatively larger mass and, in turn, have a clearly greater kinetic energy than the fibers which thereby overcome this fiber-retaining air flow and are therefore discharged tangentially under the prevailing centrifugal force.

The discharged debris particles are subsequently entrained by a second air flow and are removed through a discharge opening. The debris chamber is disposed directly following the debris discharge opening of the opening cylinder housing and is divided into a debris separation zone and a debris removal zone by an air guiding wall disposed at a short distance from the debris discharge opening.

In this manner, it is attempted to separate the air flows which are aimed in the same direction and to remove to the greatest extent possible the mutual effect of these flows on each other.

An open-end rotor spinning device with a debris chamber disposed directly underneath the opening cylinder is also known from the later-issued German Patent Publication P 43 10 810, which has two separate air flow systems with their own respective aspirating openings. In this case an air flow system acting in the bottom area of the debris chamber removes the debris particles combed out by the opening cylinder, while a second air flow system acting in the opposite direction terminates in a suction flow which rotates along with the opening cylinder. The particular disposition of the aspirating openings achieves a more or less pronounced separation of the two air flow systems.

The debris removal at the opening cylinder housing of a rotor spinning machine constitutes an important factor in the optimal processing of fiber materials. Even though the technology of the debris removal devices appears to be relatively simple, these devices are nevertheless very difficult arrangements which react very sensitively to changes. For example, small modifications in the area of the debris discharge openings can disadvantageously change the flow conditions and therefore have considerable influence on the spinning results which are obtainable.

SUMMARY OF THE INVENTION

Based on the known open-end spinning devices of the above-described type, it is an object of the present invention to further improve the debris discharge devices of such spinning units.

Briefly summarized, the present invention is adapted to substantially any open-end spinning device of the type having a sliver opening device and a pneumatically operated debris removal device disposed below or otherwise adjacent the sliver opening device. According to the present invention, an opening cylinder housing is disposed in a cover element of the spinning device, with the housing defining a debris discharge opening, and a pneumatically chargeable debris collecting element is associated with the debris discharge opening, the debris collecting element being disposed opposite the debris discharge opening at a clear spacing therefrom communicated with the ambient air.

In a particular embodiment of the invention, the cover element is pivotably supported on the open-end spinning device and the debris collecting element is releasably and adjustably mounted on the cover element, preferably by a fastening console with elongated holes. The debris collecting element preferably has an arcuate debris collection funnel oriented to taper away from the debris discharge opening, the debris collection funnel terminating in a connecting chamber disposed in the area of the pivot mounting of the cover element. The debris collecting element is connected with a suction device associated with the spinning device in the area of the pivot mounting of the cover element by suitable means by which the debris collecting element is pneumatically communicated with the suction device when the cover element is pivoted closed and is out of pneumatic communication therewith when the cover element is pivoted open.

Such an arrangement has the particular advantage that a clear separation of the adjoining fiber and debris flow systems is provided, so that neither the auxiliary fiber-controlling air flow present at the debris discharge opening nor the suction air flow required for the proper removal of debris disadvantageously affect one another.

The debris particles are combed out of the sliver by the opening cylinder and accelerated to a high speed and, because of their inherent kinetic energy and the force of gravity, pass without problems through the clear space between the debris discharge opening and the debris collecting element, which acts as a debris separation zone. The separated debris particles thus reach the area of the debris collecting element, where they are removed by means of the relatively strong suction air flow.

In the process, the auxiliary air flow, present at the debris discharge opening of the opening cylinder housing and directed onto the rotating opening cylinder to act upon the fibers, remains unaffected by the suction air flow because of the relatively large distance between the flow systems.

By disposing the debris collecting element removably on the cover element which contains the opening cylinder housing and is seated in a restrictedly movable manner on a pivot shaft, the debris collecting element advantageously can be displaced at least in a horizontal installation position via horizontally extending elongated holes in its fastening console. In this manner, it is possible to correct the installed position of the debris collecting element, if required, and to adjust it optimally to the direction of flow of the debris particles.

By the means pivotably connecting the debris collecting element with the suction device of the spinning device, a suction flow is present at the debris collecting element to assure debris removal when the cover element is closed, i.e., in the operational position of the spinning device, but in an inoperative position, when the cover element is pivoted off the spinning device, the suction connection is closed and unnecessary use of air is thereby prevented.

DETAILED DESCRIPTION OF THE PREFERRED EMBODIMENT

Figure 1:
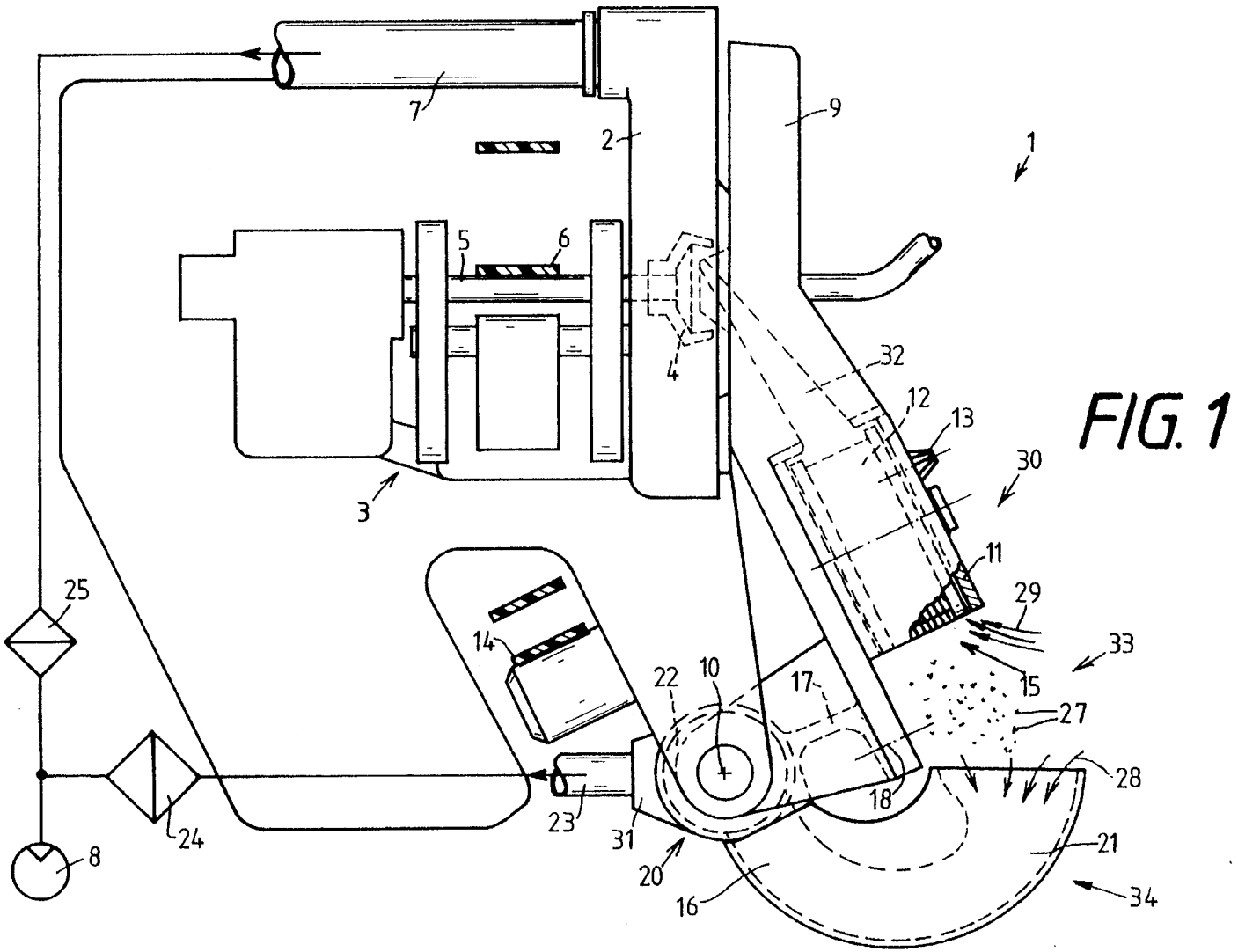
FIG. 1 is a side elevational view of the open-end spinning device of the present invention.

An open-end spinning device identified in its entirety at 1 is shown schematically in FIG. 1. As is conventional, the spinning device has a rotor housing 2 in which a spinning rotor 4 is rotatably driven at a relatively high speed through a rotor shaft 5 supported by a disk-type bearing 3 and driven by means of a tangential belt 6. The rotor housing 2 is covered at its forward side by a pivotably mounted cover element 9 and is connected to a suction device 8, which is a part of the spinning machine, via an aspiration connector tube 7 and an interposed filter element 25.

As is also known, a sliver opening device 30 is disposed in the cover element 9 and includes as its essential components a sliver opening housing 11, a sliver drawing-in cylinder 13, an opening cylinder 12 rotatably disposed in the sliver opening housing 11 and a fiber guidance conduit 32 extending to the rotor housing 2. The opening cylinder 12 is also preferably driven tangentially by a drive belt 14, while the drawing-in cylinder 13 is driven via a drive shaft (not shown) extending the length of the machine or via a direct individual drive. The opening cylinder housing 11 also has a downwardly directed debris discharge opening 15.

The cover element 9 is supported in a restrictedly movable manner on a pivot shaft 10 and a debris collecting element 16 is mounted releasably on the cover element 9 by means of a fastening console 17 having elongated holes 19 through which threaded bolts 18 extend, whereby the horizontal installation position of the debris collecting element 16 can be selectively adjusted.

The debris collecting element 16 has a debris collection funnel 21 which is open at its top and extends therefrom in a semicircular arcuate curvature, terminating in a connecting chamber 22 disposed in the area of the pivot shaft 10. The connecting chamber 22 and an aspiration connector 23 collectively form a pneumatic connecting device 20, by means of which the debris collecting element 16 is pivotably connected with the suction device 8 of the spinning machine. A filter element 24 is preferably located in the suction line leading to the suction device 8.

Figure 2:
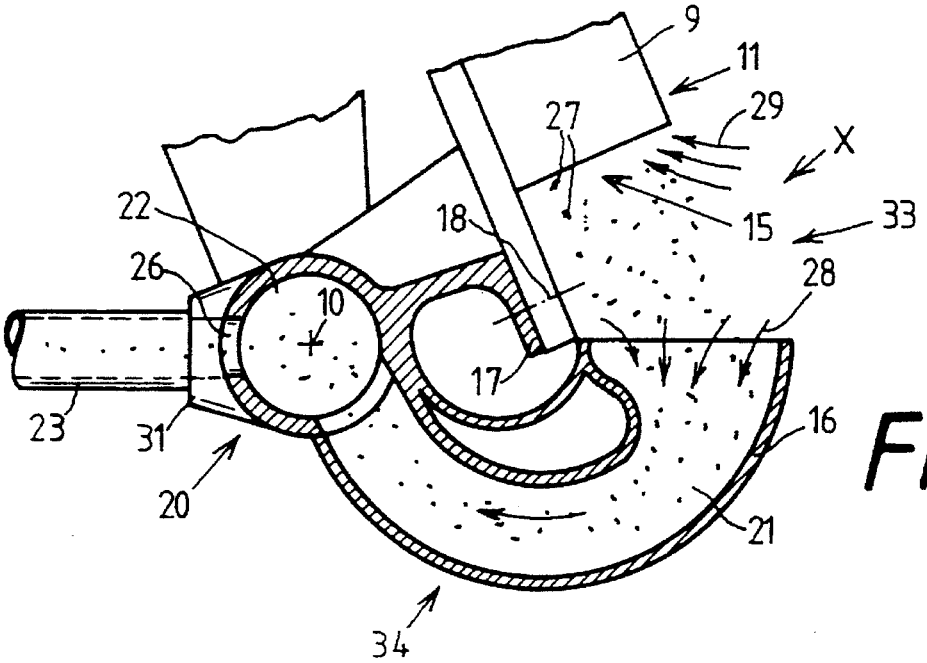
FIG. 2 is a vertical cross-sectional view of the debris collecting element thereof.
Figure 3:
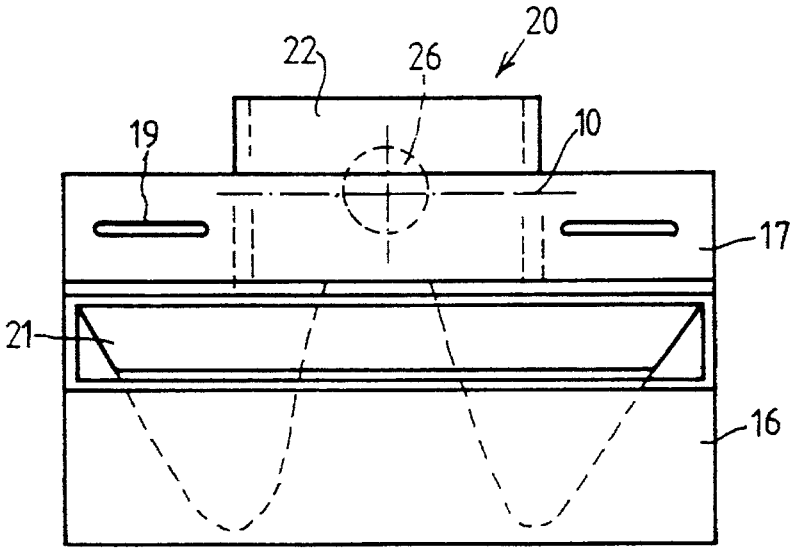
FIG. 3 is a top view of the debris collecting element in the direction of the arrow X of FIG. 2.

The connecting device 20 is configured such that, with the cover element closed, i.e., in the position for normal spinning operation, the connecting device 20 is pneumatically communicated with the suction device 8. Specifically, as indicated in FIG. 2, a connecting bore 26 is formed in the wall of the connecting chamber 22 which aligns with the clear diameter of the aspiration connector tube 23. When the cover element 9 is pivoted away from the rotor housing, the wall of the connecting chamber 22 is displaced within a sealing collar 31 disposed on the aspiration connector tube 23 such that the aspiration connector tube 23 is closed by the wall of the connecting chamber 22.

The operation of the debris removal device of the present invention may thus be understood. As indicated in FIG. 1, the rotor housing 2 and the debris collecting element 16 are connected with the suction device 8 of the spinning machine when the open-end spinning device is in its operating condition with the cover element 9 pivoted into its closed position, so that the suction force generates a vacuum in the area of the debris discharge opening 15 of the opening cylinder housing 11 as well as at the debris collecting element 16. The negative pressure present in the area of the debris discharge opening 15 causes an auxiliary air flow 29 to pass over the rotating opening cylinder 12, which is further increased by the centrifugal effect created by the rotating circumference of the opening cylinder.

The opening cylinder 12 rotates at a relatively high speed to comb individual fibers and debris particles 27 out of a sliver fed into the opening device 30. While the individual fibers are being transported via the fiber guide conduit 32 into the spinning rotor 4 under the prevailing negative pressure conditions, the debris particles 27 are discharged from the opening cylinder housing 11 at the debris discharge opening 15 because of their greater density than that of the fibers, i.e., the mass of the debris particles is relatively large in relation to their surface area. Subsequently, the debris particles 27 flow through a relatively wide clear spacing 33 between the debris discharge opening 15 and the debris collecting element 16, where they are entrained by the suction air flow 28 present thereat and are drawn into the debris collecting element 16 to be transported away.

In accordance with the present invention, the clear spacing 33 between the debris discharge opening 15 and the debris collecting element 16 is of sufficient dimension that the relatively strong suction air flow 28 at the debris collecting element 16 has no effect on the auxiliary fiber controlling air flow 29.

As a whole, the structural arrangement according to the present invention provides an optimal separation of the air flow systems 28,29 which assures that the auxiliary air flow 29 which is important to controlling the transport of fibers in the spinning process is not adversely affected by the suction air flow 28 which takes care of the debris removal, whereby the air flow separation has a positive effect on the entire spinning process.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. In combination, an open-end spinning device, a sliver opening device for delivering opened fibers to the spinning device, and a pneumatically operated debris removal device disposed below the sliver opening device for receiving and disposing of debris released from sliver opened within the opening device, wherein the spinning device comprises a spinning chamber and a cover element covering the spinning chamber, the sliver opening device comprises an opening cylinder housing disposed in the cover element, the housing defining a debris discharge opening, and the debris removal device comprises a pneumatically chargeable debris collecting element disposed below and in opposed facing relation to the debris discharge opening and separated therefrom by a clear ambient air spacing sufficient to prevent pneumatic forces within the debris removal device from affecting operation of the sliver opening device.

2. An open-end spinning device in accordance with claim 1, wherein the cover element is pivotably supported and the debris collecting element is releasably and adjustably mounted on the cover element.

3. An open-end spinning device in accordance with claim 2, wherein the debris collecting element has a fastening console with elongated holes.

4. An open-end spinning device in accordance with claim 2, wherein the debris collecting element has an arcuate debris collection funnel oriented to taper away from the debris discharge opening.

5. An open-end spinning device in accordance with claim 4, wherein the debris collection funnel includes a connecting chamber disposed in the area of the pivot mounting of the cover element.

6. An open-end spinning device in accordance with claim 1 and further comprising a suction device, the debris collecting element being pivotably connected to the suction device.

7. An open-end spinning device in accordance with claim 1 and further comprising means for connecting the debris collecting element with the suction device in the area of the mounting of the cover element to be pneumatically communicated with the suction device when the cover element is in a closed position and out of pneumatic communication therewith when the cover element is in an open position.

* * * * *